US011821114B2

(12) United States Patent
Kanesugi

(10) Patent No.: US 11,821,114 B2
(45) Date of Patent: Nov. 21, 2023

(54) ACTUATOR

(71) Applicant: BRIDGESTONE CORPORATION, Tokyo (JP)

(72) Inventor: Hiroyuki Kanesugi, Tokyo (JP)

(73) Assignee: BRIDGESTONE CORPORATION, Tokyo (JP)

( * ) Notice: Subject to any disclaimer, the term of this patent is extended or adjusted under 35 U.S.C. 154(b) by 141 days.

(21) Appl. No.: 17/284,629

(22) PCT Filed: Oct. 18, 2019

(86) PCT No.: PCT/JP2019/041214
§ 371 (c)(1),
(2) Date: Apr. 12, 2021

(87) PCT Pub. No.: WO2020/080545
PCT Pub. Date: Apr. 23, 2020

(65) Prior Publication Data

US 2021/0395927 A1 Dec. 23, 2021

(30) Foreign Application Priority Data

Oct. 19, 2018 (JP) ..... 2018-197989

(51) Int. Cl.
*F15B 15/10* (2006.01)
*D03D 1/00* (2006.01)
(Continued)

(52) U.S. Cl.
CPC ..... *D03D 1/0043* (2021.05); *D03D 3/02* (2013.01); *D03D 15/283* (2021.01); *D03D 15/41* (2021.01);
(Continued)

(58) Field of Classification Search
CPC ..... F15B 15/10; F15B 19/04; F15B 15/103; D03D 3/02
See application file for complete search history.

(56) References Cited

U.S. PATENT DOCUMENTS 4,615,260 A 10/1986 Takagi et al.
10,273,982 B2 4/2019 Tsutsui et al.
(Continued)

FOREIGN PATENT DOCUMENTS

CN 1594897 A 3/2005
CN 104948527 A 9/2015
(Continued)

OTHER PUBLICATIONS

Machine Translation is attached to WO2017138663 (translation is from 2023).*
(Continued)

*Primary Examiner* — Kenneth Bomberg
*Assistant Examiner* — Daniel S Collins
(74) *Attorney, Agent, or Firm* — Sughrue Mion, PLLC

(57) ABSTRACT

An object of the present disclosure is to provide an actuator having even better durability than the conventional actuator. Specifically, an actuator has an actuator main body constituted of a cylindrical tube capable of expanding/contracting by hydraulic pressure and a sleeve for covering an outer peripheral surface of the tube, the sleeve having a cylindrical structure formed by cords woven to be disposed in predetermined directions, wherein: the inner diameter $r_0$ (mm) of the tube, the thickness t (mm) of the tube, the storage elastic modulus E' (MPa) of the tube at 25° C., and the mesh aperture ratio A of the cords constituting the sleeve in a pressurized state satisfy the following formula (1):

$$50 \leq E' \times (t/r_0)/A \leq 600 \quad (1).$$

20 Claims, 6 Drawing Sheets

(51) Int. Cl.

| | |
|---|---|
| ***D03D 3/02*** | (2006.01) |
| ***D03D 15/283*** | (2021.01) |
| ***D03D 15/41*** | (2021.01) |
| *F01B 19/04* | (2006.01) |

(52) U.S. Cl.
CPC ..... *F15B 15/10* (2013.01); *F15B 15/103* (2013.01); *D10B 2331/021* (2013.01); *F01B 19/04* (2013.01); *F15B 2215/305* (2013.01)

(56) References Cited

U.S. PATENT DOCUMENTS

| | | | | |
|---|---|---|---|---|
| 10,774,855 | B2 | 9/2020 | Nakayama et al. | |
| 2014/0208937 | A1 | 7/2014 | Henry et al. | |
| 2019/0316608 | A1* | 10/2019 | Nakayama | F15B 15/103 |

FOREIGN PATENT DOCUMENTS

| | | | | |
|---|---|---|---|---|
| CN | 106837913 | A | 6/2017 | |
| JP | 52-40378 | B2 | 10/1977 | |
| JP | 60-139905 | A | 7/1985 | |
| JP | 61-236905 | A | 10/1986 | |
| JP | 2009-250362 | A | 10/2009 | |
| WO | WO-2017138663 | A1 * | 8/2017 | F15B 15/10 |
| WO | 2018/084122 | A1 | 5/2018 | |
| WO | 2018/084123 | A1 | 5/2018 | |

OTHER PUBLICATIONS

Extended European Search Report dated May 25, 2022 in European Application No. 19874620.8.

International Search Report for PCT/JP2019/041214 dated Dec. 10, 2019 (PCT/ISA/210).

International Preliminary Report on Patentability dated Apr. 14, 2021 in International Application No. PCT/JP2019/041214 English Translation.

Search Report dated Dec. 15, 2022 issued by the Chinese Patent Office in Chinese Application No. 201980068888.3.

* cited by examiner

ACTUATOR

CROSS REFERENCE TO RELATED APPLICATIONS

This application is a National Stage of International Application No. PCT/JP2019/041214 filed Oct. 18, 2019, claiming priority based on Japanese Patent Application No. 2018-197989 filed Oct. 19, 2018.

TECHNICAL FIELD

The present invention relates to an actuator.

BACKGROUND ART

Conventionally, there has been widely used as an actuator for expanding/contracting a tube a pneumatic actuator having a rubber tube (a tube-shaped body) capable of expanding/contracting by using air as hydraulic fluid and a sleeve (a woven reinforcing structure) covering an outer peripheral surface of the tube, i.e. a McKibben type actuator (refer to PTL1, for example). Respective end portions of an actuator main body constituted of a tube and a sleeve as described above are caulked by using a sealing member formed by metal. The sleeve is a cylindrical structure formed by woven high tensile strength fiber cords such as polyamide fibers or metal cords, for regulating expansion movements of the tube within a predetermined range. Such a pneumatic actuator as described above, which is used in various fields, is suitably employed as an artificial muscle for a nursing care/healthcare device in particular. However, such a conventional pneumatic actuator as described above using air as hydraulic fluid does not have particularly high strength (pressure resistance), which strength is only around 0.5 MPa at most, for example.

In this respect, durability of the conventional pneumatic actuator mentioned above is not satisfactory when the actuator is employed as a hydraulic actuator using liquid such as oil, water or the like as hydraulic fluid because a hydraulic actuator is generally subjected to high pressure, e.g. 50 MPa. PTL 2 proposes, in this regard, a hydraulic actuator having a tube with a laminated structure of two or more rubber layers including at least one polar rubber layer and at least one no-polar rubber layer, so that durability thereof is improved as compared with the conventional pneumatic actuator.

CITATION LIST

Patent Literature

PTL 1: JP 61-236905 Laid-Open
PTL 2: WO2018/084123

SUMMARY

However, as a result of a keen study, the inventor of the present disclosure revealed that the hydraulic actuator disclosed in PTL 2 still has room for improvement in terms of durability thereof, although it has indeed better durability than the conventional pneumatic actuator.

In view of this, an object of the present disclosure is to solve the prior art problems described above and provide an actuator having even better durability than the conventional actuator.

Primary features of the present disclosure for achieving the aforementioned object are as follows.

An actuator of the present disclosure, having an actuator main body constituted of a cylindrical tube capable of expanding/contracting by hydraulic pressure and a sleeve for covering an outer peripheral surface of the tube, the sleeve having a cylindrical structure formed by cords woven to be disposed in predetermined directions, wherein:

the inner diameter $r_0$ (mm) of the tube, the thickness t (mm) of the tube, the storage elastic modulus E' (MPa) of the tube at 25° C., and the mesh aperture ratio A of the cords constituting the sleeve in a pressurized state satisfy the following formula (1):

$$50 \leq E' \times (t/r_0)/A \leq 600 \quad (1)$$

The actuator of the present disclosure has even better durability than the conventional actuator.

In the actuator of the present disclosure, it is preferable that the tube includes one or more rubber layers and at least one of the rubber layers contains at least one selected from the group consisting of natural rubber, isoprene rubber, styrene-butadiene rubber, butadiene rubber, chloroprene rubber, ethylene-propylene-diene rubber, acrylonitrile-butadiene rubber, hydrogenated acrylonitrile-butadiene rubber, butyl rubber, polyisobutylene rubber, silicone rubber, urethane elastomer, polyvinyl alcohol resin, acrylate resin, ethylene polyvinyl alcohol resin, cellulose-based resin, polyamide-based resin, polyacrylic acid, modified products thereof, and at least partially hydrogenated products thereof. Durability of the actuator further improves in this case.

In the actuator of the present disclosure, it is preferable that the tube includes one or more rubber layers and at least one of the rubber layers contains at least one filler selected from the group consisting of carbon black and silica. Durability of the actuator further improves in this case.

In the present disclosure, it is preferable that at least one of the aforementioned rubber layers contains at least one filler selected from the group consisting of carbon black and silica by the total amount of 30 parts by mass with respect to 100 parts by mass of the rubber component. Durability of the actuator further improves in this case.

In a preferable example of the actuator of the present disclosure, the cords which constitute the sleeve is made of at least one fiber material selected from the group consisting of polyamide fiber, polyester fiber, polyurethane fiber, rayon, acrylic fiber, and polyolefin fiber. Durability of the actuator further improves in this case.

In the present disclosure, it is particularly preferable that the cords constituting the sleeve is made of aramid fiber. Durability of the actuator further improves in this case.

In another preferable example of the actuator of the present disclosure, the fineness (dtex) per one raw yarn of the cords constituting the sleeve is in the range of 800 dtex to 5000 dtex. Durability of the actuator further improves in this case.

In yet another preferable example of the actuator of the present disclosure, the second twist number (number/10 cm) and the first twist number (number/10 cm) are in the range of 4 to 150 (number/10 cm), respectively. Durability of the actuator further improves in this case.

In yet another preferable example of the actuator of the present disclosure, the average angle θ formed by the cords of the sleeve with respect to the axis direction of the actuator with no load and no pressure applied thereon is in a range of 25° to 40°. Durability of the actuator further improves in this case.

In yet another preferable example of the actuator of the present disclosure, the number of woven cords constituting the sleeve is in the range of 48 to 96 and the number of bundle (the number of twisted yarn(s) delivered per cord) is in the range of 1 to 2/cord. Durability of the actuator further improves in this case.

According to the present disclosure, it is possible to provide an actuator having even better durability than the conventional actuator.

DETAILED DESCRIPTION

Hereinafter, the actuator of the present disclosure will be demonstratively described in detail based on embodiments thereof.

Figure 1:
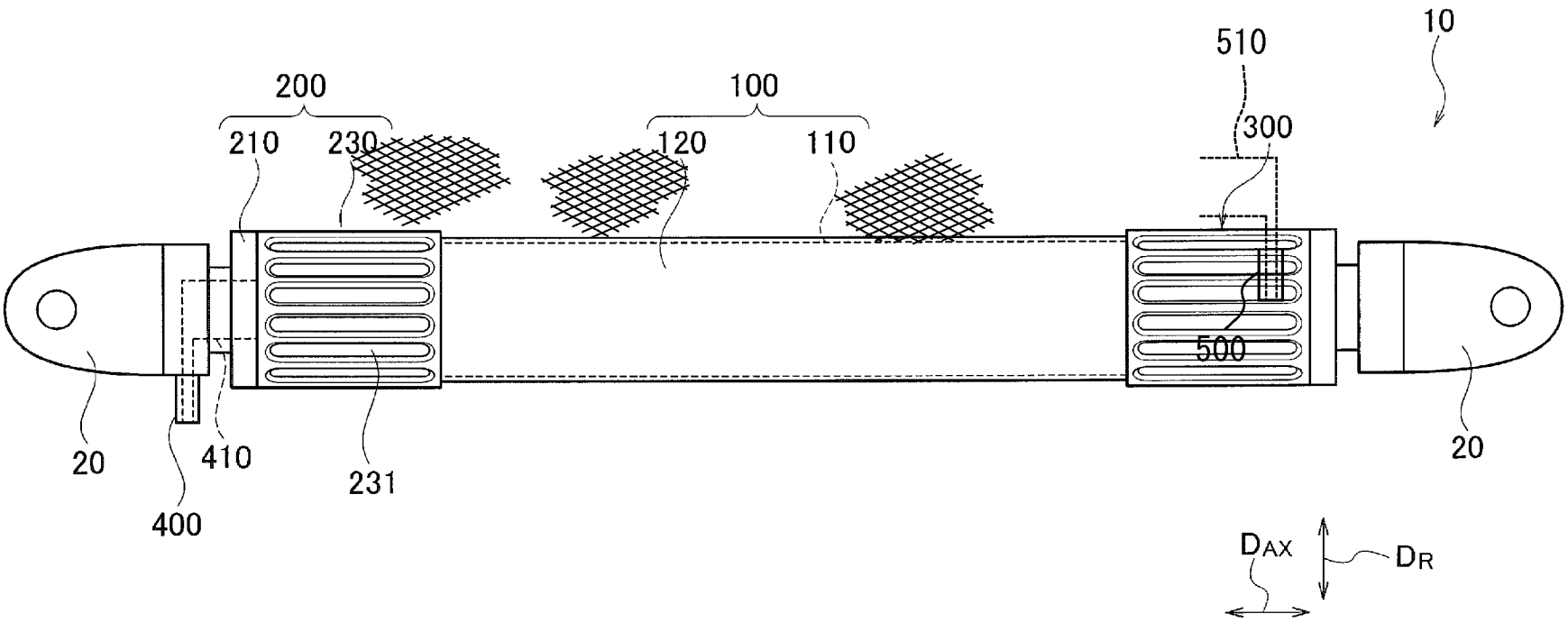
FIG. 1 is a side view of an embodiment of a hydraulic actuator 10.

FIG. 1 is a side view of an actuator 10 according to an embodiment of the present disclosure. As shown in FIG. 1, the actuator 10 has an actuator main body 100, a sealing mechanism 200, and another sealing mechanism 300. Respective connection portions 20 are provided at respective ends of the actuator 10.

The actuator main body 100 is constituted of a tube 110 and a sleeve 120. A hydraulic fluid flows into the actuator main body 100 via a fitting 400 and a passage hole 410. The actuator of the present disclosure is hydraulically operated by either air pressure or liquid pressure. In a case where a liquid is used as the hydraulic fluid, examples of the liquid include oil, water, and the like. In a case where the actuator of the present disclosure is operated by oil pressure, a hydraulic oil conventionally employed in a system driven by oil pressure may be used as the hydraulic fluid.

The actuator main body 100, when the hydraulic fluid flows into the tube 110, contracts in the axis direction $D_{AX}$ and expands in the radial direction DR of the actuator main body 100. On the other hand, the actuator main body 100, when the hydraulic fluid flows out of the tube 110, expands in the axis direction $D_{AX}$ and contracts in the radial direction DR of the actuator main body 100. The actuator 10 functions as an actuator by such changes in configuration of the actuator main body 100 as described above.

The actuator 10 as described above is what is called a McKibben type actuator, which is applicable to artificial muscles of course and can also be suitably used for limbs (upper limbs and lower limbs) of a robot, which limbs require higher capacity (contraction force) than artificial muscles. The connection portions 20 are connected to members constituting the limbs, or the like.

The sealing mechanism 200 and the sealing mechanism 300 seal end portions of the actuator main body 100 in the axis direction $D_{AX}$ thereof, respectively. Specifically, the sealing mechanism 200 includes a sealing member 210 and a caulking member 230. The sealing member 210 seals an end portion in the axis direction $D_{AX}$ of the actuator main body 100. The caulking member 230 caulks the actuator main body 100 in collaboration with the sealing member 210. Indentations 231 as marks made by the caulking jigs are formed at an outer peripheral surface of the caulking member 230.

Differences between the sealing mechanism 200 and the sealing mechanism 300 reside in how the fitting 400 and a fitting 500 (and the passage hole 410 and a passage hole 510) function, respectively.

The fitting 400 provided in the sealing mechanism 200 protrudes such that the fitting 400 can be mounted to a driving pressure source of the actuator 10, or more specifically a hose (a piping path) connected to a compressor of the hydraulic fluid. The hydraulic fluid which has flowed into the actuator via the fitting 400 then flows into the inside of the actuator main body 100, or more specifically the inside of the tube 110, via the passage hole 410.

On the other hand, the fitting 500 provided in the sealing mechanism 300 protrudes such that it can be used for gas venting when the hydraulic fluid is injected into the actuator. When the hydraulic fluid is injected into the actuator at the initial operation stage of the actuator, gas present inside the actuator is discharged from the fitting 500 via the passage hole 510.

Figure 2:
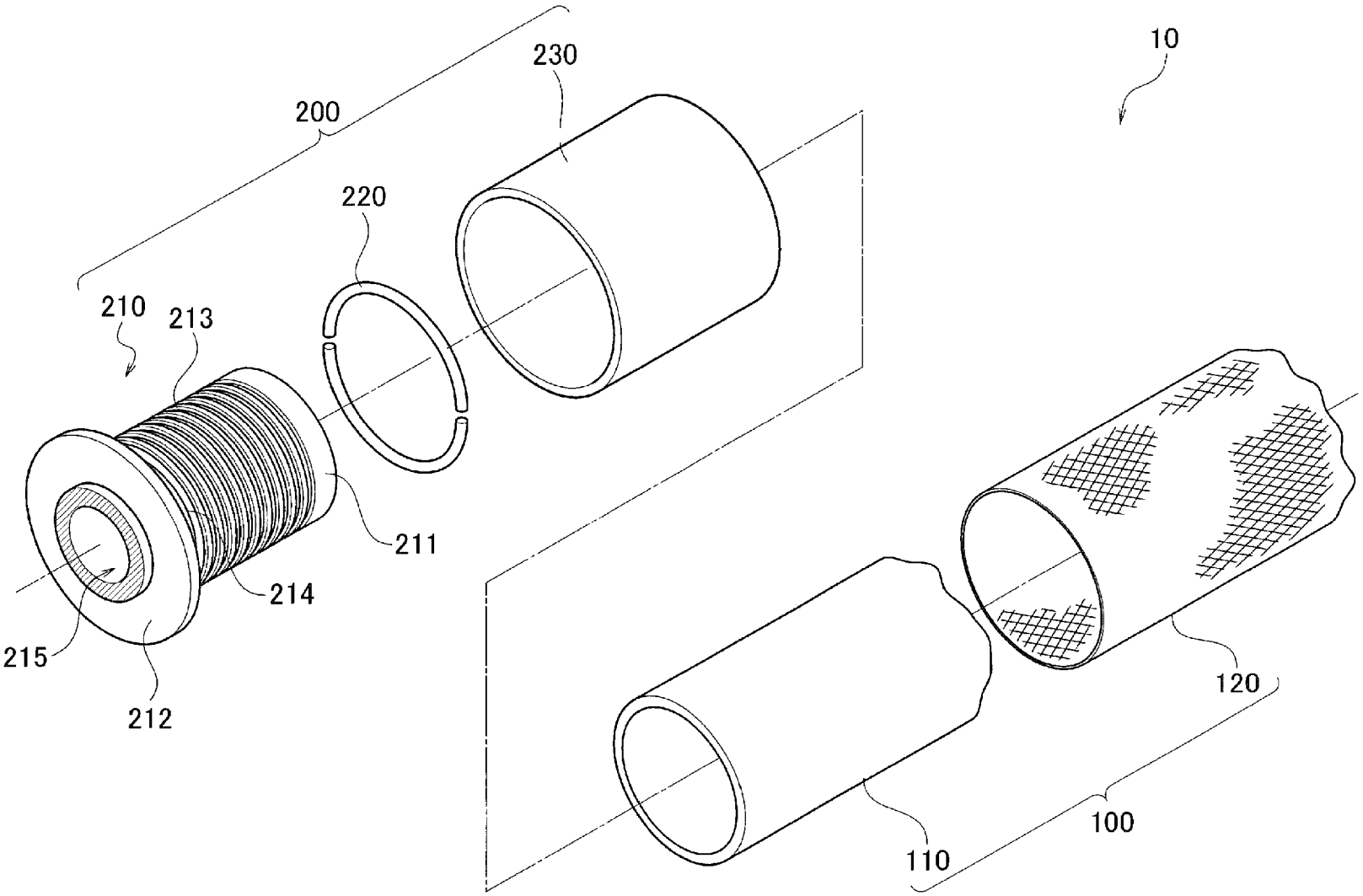
FIG. 2 is a partially exploded perspective view of an embodiment of the hydraulic actuator 10.

FIG. 2 is a partially exploded perspective view of the actuator 10. As shown in FIG. 2, the actuator 10 has the actuator main body 100 and the sealing mechanism 200. The actuator main body 100 is constituted of the tube 110 and the sleeve 120, as described above.

The tube 110 is a cylindrical, pipe-like member capable of expanding/contracting by hydraulic pressure. The tube 110, which is to repeat contracting and expanding movements alternately by the hydraulic fluid, is made of an elastic material such as rubber.

The sleeve 120 has a cylindrical configuration and covers an outer peripheral surface of the tube 110. The sleeve 120 has a woven structure formed by weaving cords to be disposed in certain directions, wherein the cords thus disposed intersect each other in a woven manner to provide rhombus configurations in a repetitive and continuous manner. The sleeve 120 having such a configuration as described above can deform like a pantograph and follow contraction/expansion of the tube 110, while also regulating the contraction/expansion.

In FIG. 2, the sealing mechanism 200 seals an end portion in the axis direction $D_{AX}$ of the actuator main body 100. The sealing mechanism 200 includes the sealing member 210, a locking ring 220 and the caulking member 230.

The sealing member 210 has a trunk portion 211 and a flange portion 212. Metal such as stainless steel can be suitably used for the sealing member 210. However, the material for the sealing member 210 is not restricted to metal and a hard plastic material or the like can be used instead of metal.

The trunk portion 211 has a tube-like shape. A passage hole 215 through which the hydraulic fluid flows is formed in the trunk portion 211. The passage hole 215 communicates with the passage hole 410 (see FIG. 1). The trunk portion 211 is inserted into the tube 110.

The flange portion 212, which is integral with the trunk portion 211, is positioned further on the side of the axis direction $D_{AX}$ end portion of the actuator 10 than the trunk portion 211. The flange portion 212 has a larger outer diameter in the radial direction DR than the outer diameter of the trunk portion 211. The flange portion 212 is fixedly engaged with the tube 110 having the trunk portion 211 inserted therein and the locking ring 220.

Irregular portions 213 are formed at an outer peripheral surface of the trunk portion 211. The irregular portions 213 contribute to suppressing slippage of the tube 110 relative to the trunk portion 211 inserted therein. The irregular portions 213 preferably include at least three projecting portions.

Further, a small diameter portion 214, of which outer diameter is smaller than that of the trunk portion 211, is formed in a portion adjacent to the flange portion 212, of the trunk portion 211.

The locking ring 220 is fixedly engaged with the sleeve 120. Specifically, the sleeve 120 is folded on the outer side in the radial direction DR and backward by way of the locking ring 220 (not shown in FIG. 2. See FIG. 3).

The outer diameter of the locking ring 220 is larger than that of the trunk portion 211.

The locking ring 220 is fixedly engaged with the sleeve 120 at the position of the small diameter portion 214 of the trunk portion 211. That is, the locking ring 220 is fixedly engaged with the sleeve 120 at a position adjacent to the flange portion 212 and on the radial direction DR outer of the trunk portion 211.

The locking ring 220 has a configuration split into two portions in the present embodiment, so that the locking ring 220 can be engaged with the small diameter portion 214 having an outer diameter smaller than that of the trunk portion 211. It should be noted that the configuration of the locking ring 220 is not restricted to the aforementioned two-split one. The locking ring 220 may be split into three or more portions and some of the split portions may be pivotably linked with each other. Any of metal, a hard plastic material or the like, i.e. those similar to the materials for the sealing member 210, can be used as a material for the locking ring 220.

The caulking member 230 caulks the actuator main body 100 in collaboration with the sealing member 210. Metal such as aluminum alloy, brass, iron or the like can be used as a material for the caulking member 230. Indentations 231 as shown in FIG. 1 are formed at an outer surface of the caulking member 230 as a result of the caulking member's being caulked by the caulking jigs.

Figure 3:
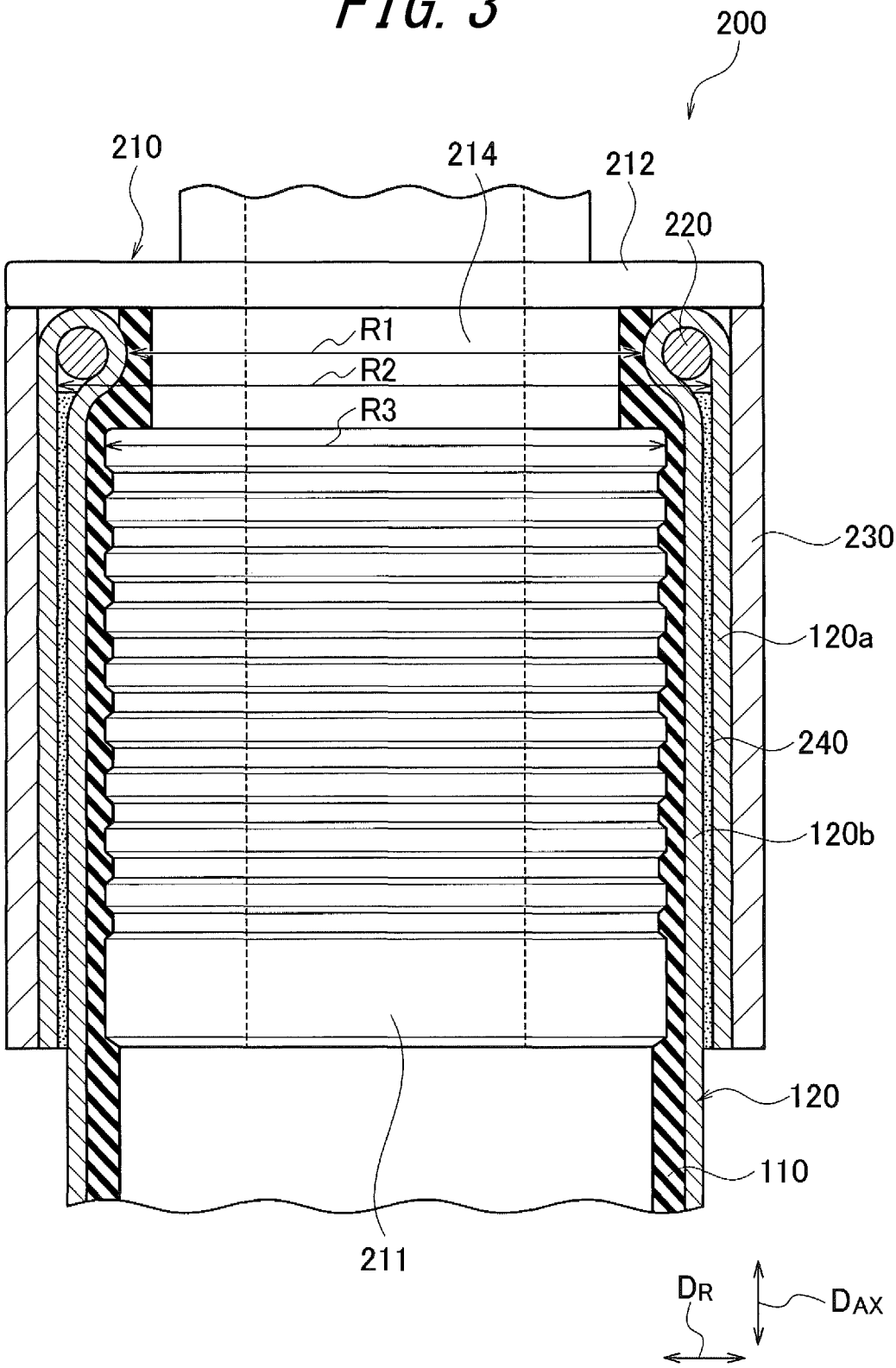
FIG. 3 is a partial sectional view of the actuator 10 including a sealing mechanism 200, cut along the axis direction $D_{AX}$ thereof.

FIG. 3 is a partial sectional view of the actuator 10 including the sealing mechanism 200, cut along the axis direction $D_{AX}$ of the actuator.

The sealing member 210 has the small diameter portion 214, of which outer diameter is smaller than that of the trunk portion 211, as described above.

The locking ring 220 is disposed on the outer side in the radial direction DR of the small diameter portion 214. The inner diameter R1 of the locking ring 220 is smaller than the outer diameter R3 of the trunk portion 211. The outer diameter R2 of the locking ring 220 is larger than the outer dimeter R3 of the trunk portion 211. It is acceptable that the outer diameter R2 of the locking ring 220 is also smaller than the outer diameter R3 of the trunk portion 211 in this regard.

The trunk portion 211 is inserted into the tube 110 such that the tube 110 is in contact with the flange portion 212. The sleeve 120, on the other hand, is folded on the outer side in the radial direction DR and then backward via the locking ring 220. As a result, the sleeve 120 has a folded-back portion 120*a*, which has been folded backward by way of the locking ring 220 at the end in the axis direction $D_{AX}$ of the actuator. Specifically, the sleeve 120 includes: a sleeve main body 120*b* covering the outer peripheral surface of the tube 110; and the folded-back portion 120*a* folded backward at the end in the axis direction $D_{AX}$ of the sleeve main body 120*b* to be disposed on the outer peripheral side of the sleeve main body 120*b*.

The folded-back portion 120*a* is attached to the sleeve main body 120*b* situated on the outer side in the radial direction DR, of the tube 110. Specifically, an adhesive layer 240 is formed between the sleeve main body 120*b* and the folded-back portion 120*a*, so that the sleeve main body 120*b* and the folded-back portion 120*a* are fixedly attached to each other by the adhesive layer 240. An appropriate adhesive can be used for the adhesive layer 240 in accordance with the type of the cords constituting the sleeve 120.

The adhesive layer 240, however, is not essentially needed in the present disclosure and it is acceptable that the folded-back portion 120*a* is not fixedly attached to the sleeve main body 120*b*.

The trunk portion 211 of the sealing member 210 is inserted into the caulking member 230 having an inner diameter larger than the outer diameter of the trunk portion 211 and then the caulking member is caulked by the jig members. The caulking member 230 caulks the actuator main body 100 in collaboration with the sealing member 210. Specifically, the caulking member 230 caulks the tube 110 having the trunk portion 211 inserted therein, the sleeve main body 120*b*, and the folded-back portion 120*a*. That is, the caulking member 230 caulks the tube 110, the sleeve main body 120*b*, and the folded-back portion 120*a* in collaboration with the sealing member 210.

Figure 4:
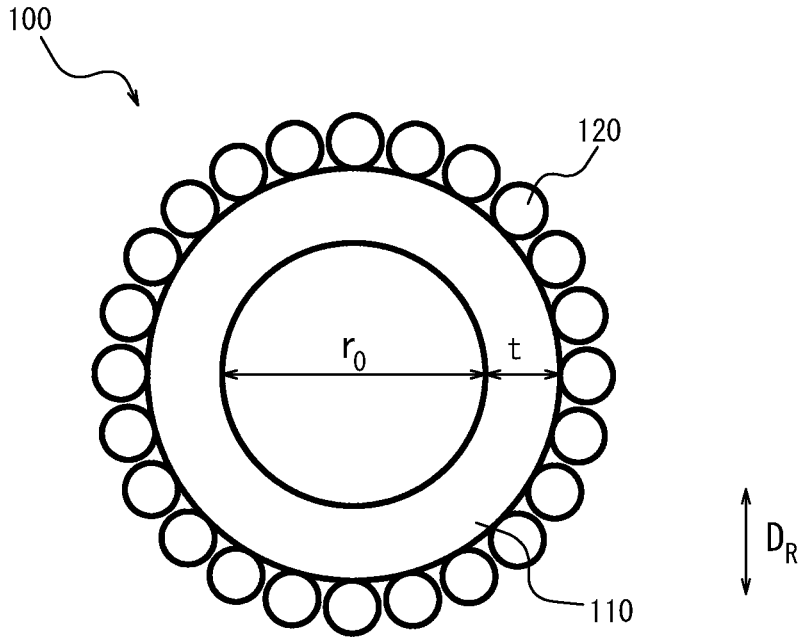
FIG. 4 is a cross sectional view in the radial direction DR of an actuator main body 100.

FIG. 4 is a cross sectional view in the radial direction DR of the actuator main body 100. As shown in FIG. 4, the tube 110 has the inner diameter $r_0$ (mm) and the thickness t (mm) and the outer peripheral surface thereof is covered with the sleeve 120.

The inner diameter $r_0$ of the tube 110 is preferably ≥5.0 mm and ≤12 mm with no load and no pressure applied thereon. The inner diameter $r_0$ of the tube 110, of 5.0 mm, ensures a satisfactorily large contraction rate of the tube 110, thereby improving the output of the actuator. The inner diameter $r_0$ of the tube 110, of 12 mm, allows the mesh aperture ratio of the cords constituting the sleeve in a pressurized state to be satisfactorily small even when the number of woven cords is 96, which is the upper limit of the number in terms of ensuring smooth sleeve production.

The thickness t of the tube 110 with no load and no pressure applied thereon is preferably in the range of 1.0 mm to 6.0 mm and more preferably in the range of 1.4 mm to 5.0 mm. The thickness t of the tube 110, of 1.0 mm, improves strength of the tube 110 and well suppresses protrusion of the tube 110 from clearances between the cords constituting the sleeve 120, thereby further improving durability of the actuator. The thickness t of the tube 110, of 6.0 mm, ensures a satisfactorily large contraction rate and thus a satisfactorily large magnitude of contraction/expansion of the tube 110.

The storage elastic modulus E' of the tube 110 at 25° C. is preferably in the range of 10 MPa to 40 MPa. The storage elastic modulus E' of the tube 110 at 25° C., of ≥10 MPa, well suppresses protrusion of the tube 110 from clearances 122 between the cords 121 constituting the sleeve 120, thereby further improving durability of the actuator. The storage elastic modulus E' of the tube 110 at 25° C., of 40 MPa, ensures a satisfactorily large contraction rate and thus a satisfactorily large magnitude of contraction/expansion of the tube 110.

The storage elastic modulus E' of the tube 110 at 25° C. can be adjusted by changing blend formulation of a raw material composition for use in the tube 110. The storage elastic modulus E' of the tube 110 at 25° C. is measured according to the method described in the Examples in the present disclosure.

Figure 5A:
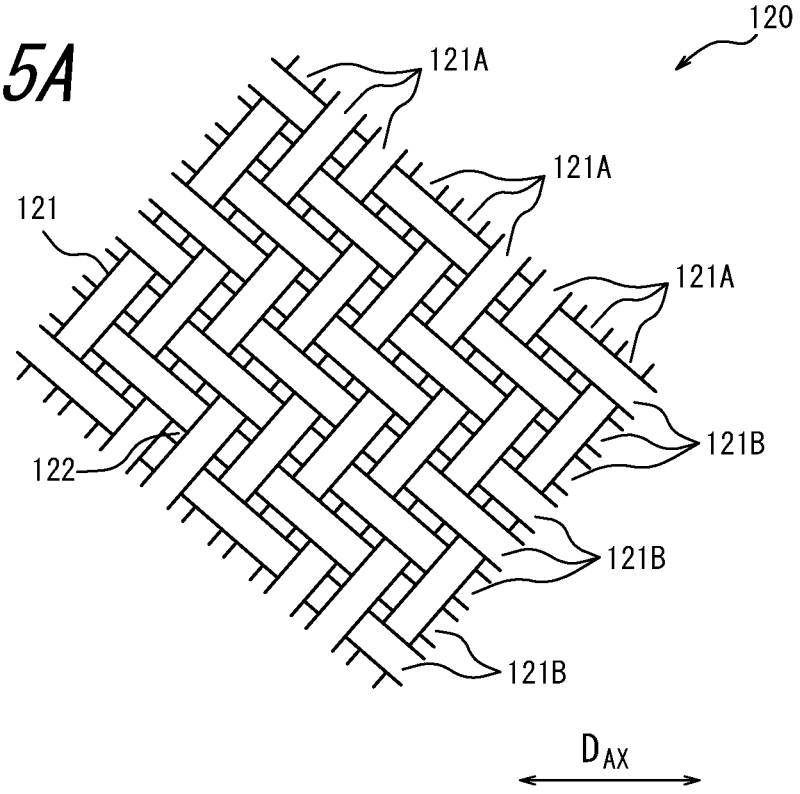
FIGS. 5A and 5B are partial side views of two embodiments of a sleeve 120 in a pressurized state, respectively.
Figure 5B:
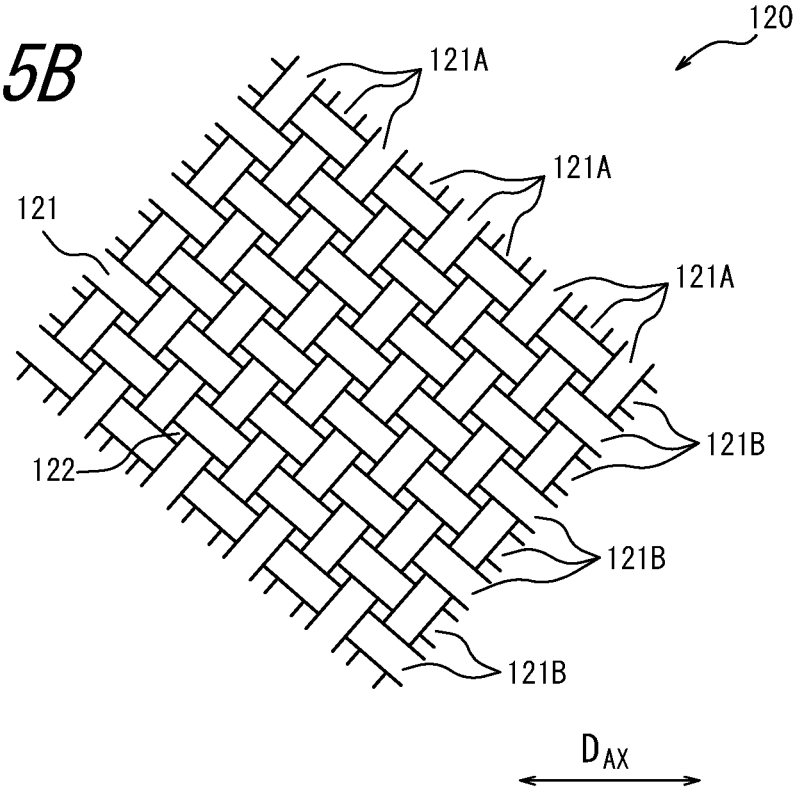

FIGS. 5A and 5B are partial side views of two embodiments of a sleeve 120 in a pressurized state, respectively.

As shown in FIGS. 5A and 5B, in the present disclosure, the mesh aperture ratio A of the cords 121 constituting the sleeve 120 in a pressurized state is a ratio (S2/S1) of the total area (S2) of clearances 122 between the cords 121 constituting the sleeve 120 with respect to an area (S1) of an outer peripheral surface of the actuator main body 100 or, in other words, a ratio (S2'/S1') of the sum (S2') of the areas exposed at clearances 122 between the cords 121 constituting the sleeve 120, of the tube 110, with respect to an area (S1') of an outer peripheral surface of the tube 110.

A "pressurized state" represents a state in which the internal pressure of the actuator is set to be 5 MPa in the present disclosure.

The mesh aperture ratio A of the cords constituting the sleeve in a pressurized state is preferably in the range of 0.005 (0.5%) to 0.06 (6.0%). The mesh aperture ratio A of the cords constituting the sleeve in a pressurized state, of 0.005 (0.5%), ensures a satisfactorily large contraction rate and thus a satisfactorily large magnitude of contraction/expansion of the actuator. The mesh aperture ratio A of the cords constituting the sleeve in a pressurized state, of 0.06 (6.0%), well suppresses protrusion of the tube 110 from the clearances 122 between the cords 121 constituting the sleeve 120, thereby further improving durability of the actuator.

The mesh aperture ratio A of the cords 121 constituting the sleeve 120 in a pressurized state can be adjusted by optionally selecting a weaving method of the sleeve 120 and fineness, the twist number, the number of woven cords, the diameter, the material type, the cord-driving density, and the like of the cords 121 to be used.

The actuator of the present disclosure is characterized in that the inner diameter $r_0$ (mm) of the tube 110, the thickness t (mm) of the tube 110, the storage elastic modulus E' (A/Pa) of the tube 110 at 25° C., and the mesh aperture ratio A of the cords 121 constituting the sleeve 120 in a pressurized state satisfy the following formula (1):

$$50 \leq E' \times (t/r_0)/A \leq 600 \quad (1)$$

"$E' \times (t/r_0)/A$" in the formula (1) will occasionally be referred to as the "durability factor value" in the present disclosure hereinafter.

The following cases are predicted to exhibit the durability factor value of less than 50.

First case: a case where the inner diameter $r_0$ (mm) of the tube 110, the thickness t (mm) of the tube 110, and the mesh aperture ratio A of the cords 121 constituting the sleeve 120 in a pressurized state are constant, while the storage elastic modulus E' (MPa) of the tube 110 at 25° C. is excessively low.

When the storage elastic modulus E' of the tube 110 at 25° C. is excessively low, the tube 110 is relatively easily pushed out of the clearances 122 between the cords 121 constituting the sleeve 120, whereby the number of successful operations of the actuator, counted before the tube 110 is out of order due to cracks, decreases.

Second case: a case where the inner diameter $r_0$ (mm) of the tube 110, the storage elastic modulus E' (MPa) of the tube 110 at 25° C., and the mesh aperture ratio A of the cords 121 constituting the sleeve 120 in a pressurized state are constant, while the thickness t (mm) of the tube 110 is excessively small.

When the thickness t of the tube 110 is excessively small, a distance in which a crack generated in the tube 110 needs to propagate in order to penetrate through the tube 110 decreases, whereby the number of successful operations of the actuator, counted before the tube 110 is out of order due to cracks, decreases.

Third case: a case where the thickness t (mm) of the tube 110, the storage elastic modulus E' (MPa) of the tube 110 at 25° C., and the mesh aperture ratio A of the cords 121 constituting the sleeve 120 in a pressurized state are constant, while the inner diameter $r_0$ (mm) of the tube 110 is excessively large.

When the inner diameter $r_0$ of the tube 110 is excessively large, a stress exerted on the tuber 110 in the circumferential direction thereof increases, whereby the number of successful operations of the actuator, counted before the tube 110 is out of order due to cracks, decreases.

Fourth case: a case where the inner diameter $r_0$ (mm) of the tube 110, the thickness t (mm) of the tube 110, and the storage elastic modulus E' (MPa) of the tube 110 at 25° C. are constant, while the mesh aperture ratio A of the cords 121 constituting the sleeve 120 in a pressurized state is excessively large.

When the mesh aperture ratio A of the cords 121 constituting the sleeve 120 in a pressurized state is excessively large, the tube 110 is relatively easily pushed out of the clearances 122 between the cords 121 constituting the sleeve 120, whereby the number of successful operations of the actuator, counted before the tube 110 is out of order due to cracks, decreases.

On the other hand, the following cases are predicted to exhibit the durability factor value exceeding 600.

First case: a case where the inner diameter $r_0$ (mm) of the tube 110, the thickness t (mm) of the tube 110, and the mesh aperture ratio A of the cords 121 constituting the sleeve 120 in a pressurized state are constant, while the storage elastic modulus E' (MPa) of the tube 110 at 25° C. is excessively high.

When the storage elastic modulus E' of the tube 110 at 25° C. is excessively high, contraction behavior of the actuator is significantly restricted, whereby the actuator cannot exhibit a satisfactory contraction force and no longer properly works as an actuator.

Second case: a case where the inner diameter $r_0$ (mm) of the tube 110, the storage elastic modulus E' (MPa) of the tube 110 at 25° C., and the mesh aperture ratio A of the cords 121 constituting the sleeve 120 in a pressurized state are constant, while the thickness t (mm) of the tube 110 is excessively large.

When the thickness t of the tube 110 is excessively large, contraction behavior of the actuator is significantly restricted, whereby the actuator cannot exhibit a satisfactory contraction force and no longer properly works as an actuator.

Third case: a case where the thickness t (mm) of the tube 110, the storage elastic modulus E' (MPa) of the tube 110 at 25° C., and the mesh aperture ratio A of the cords 121 constituting the sleeve 120 in a pressurized state are constant, while the inner diameter $r_0$ (mm) of the tube 110 is excessively small.

When the inner diameter $r_0$ of the tube 110 is excessively small, the diameter of an insertion portion of the sealing mechanism 200 has to be small, as well, whereby strength of the actuator significantly decreases.

Fourth case: a case where the inner diameter $r_0$ (mm) of the tube 110, the thickness t (mm) of the tube 110, and the storage elastic modulus E' (MPa) of the tube 110 at 25° C.

are constant, while the mesh aperture ratio A of the cords 121 constituting the sleeve 120 in a pressurized state is excessively small.

When the mesh aperture ratio A of the cords 121 constituting the sleeve 120 in a pressurized state is excessively small, movements of the cords 121 constituting the sleeve 120 are significantly restricted in a pressurized state, whereby the actuator fails to contract in a satisfactory manner and thus no longer properly works as an actuator.

In contract, the actuator of the present disclosure, adapted to have the durability factor value $[E' \times (t/r_0)/A]$ in the range of ≥50 and ≤600, can function as an actuator in a reliable and satisfactory manner and exhibits significantly improved durability, as well. For example, the actuator has such high durability as allows it to successfully operate 8000 times or more even when it repeats contractions at a contraction rate of ≥20% in a state where it is pressurized at 5 MPa. The durability factor value is preferably ≥60, more preferably ≥70, and preferably ≤500, more preferably ≤400, even more preferably ≤300, yet even more preferably ≤200, particularly preferably ≤100, most preferably ≤90, and preferably in the range of ≥60 and ≤200.

The tube 110 is a cylindrical, pipe-like member capable of expanding/contracting by hydraulic pressure and is to repeat contracting and expanding movements alternately by the hydraulic fluid, as described above. It is therefore preferable that the tube 110 is made of rubber and includes at least one rubber layer. Although the tube 110 shown in FIGS. 1 to 4 has a single-layer structure, it is acceptable in the present disclosure that the tube 110 has a multi-layer structure. Further, the (outer) diameter dimension of the tube 110 may be set appropriately in accordance with the intended application.

When the tube 110 has a single-layer structure, the actuator of the present disclosure is preferably used as a pneumatic actuator, although it is applicable to either a pneumatic actuator or a hydraulic actuator. When the tube 110 has a multi-layer structure, the actuator of the present disclosure is preferably used as either a pneumatic actuator or a hydraulic actuator.

It is preferable that at least one of the rubber layers of the tube 110 contains as a rubber component(s) at least one selected from the group consisting of natural rubber (NR), isoprene rubber (IR), styrene-butadiene rubber (SBR), butadiene rubber (BR), chloroprene rubber (CR), ethylene-propylene-diene rubber (EPDM), acrylonitrile-butadiene rubber (NBR, which may occasionally be referred to as "nitrile rubber"), hydrogenated acrylonitrile-butadiene rubber (H-NBR, which may occasionally be referred to as "hydrogenated nitrile rubber"), butyl rubber (IIR), polyisobutylene rubber, silicone rubber, urethane elastomer, polyvinyl alcohol resin, acrylate resin, ethylene polyvinyl alcohol resin, cellulose-based resin, polyamide-based resin, polyacrylic acid, modified products thereof, and at least partially hydrogenated products thereof. It is more preferable that at least one of the rubber layers of the tube 110 contains at least one of the substances described above by the total amount in the range of 50 to 100 parts by mass with respect to 100 parts by mass of the rubber component. Durability of the tube 110 improves and thus durability of the actuator further improves in this case. Either a single type or two or more types in a blended state of the aforementioned examples may be used as the rubber component.

In a case where the tube 110 has a multi-layer structure, the innermost layer of the rubber layers, which layer is brought into contact with a hydraulic fluid, preferably contains a rubber component adapted to the hydraulic fluid. Examples of the rubber component include: NBR and hydrogenated NBR when the hydraulic fluid is oil; and EPDM, NR, BR, and CR when the hydraulic fluid is water.

The rubber layer may contain a rubber component other than the rubber component examples described above.

In the present disclosure, it is preferable that at least one of the rubber layers contains at least one selected from the group consisting of natural rubber, butadiene rubber, acrylonitrile-butadiene rubber, hydrogenated acrylonitrile-butadiene rubber, ethylene-propylene-diene rubber, and chloroprene rubber by the total amount of ≥50 parts by mass with respect to 100 parts by mass of the rubber component. Durability of the tube 110 improves and thus durability of the actuator further improves in this case.

It is preferable that at least one of the rubber layers of the tube 110 contains at least one filler selected from the group consisting of carbon black and silica. Durability of the tube 110 improves and thus durability of the actuator further improves when at least one of the rubber layers of the tube contains carbon black and/or silica. Types of the carbon black is not particularly restricted and examples of the grade thereof include GPF, FEF, HAF, ISAF, and SAF. Either a single type or at least two types in combination of the aforementioned examples can be used as the carbon black. Types of the silica is not particularly restricted and examples thereof include wet silica (hydrated silica), dry silica (anhydrous silica), calcium silicate, aluminum silicate, and the like. Wet silica is preferable among these examples. Either a single type or at least two types in combination of the aforementioned examples can be used as the silica.

In the present disclosure, at least one of the rubber layers contains at least one filler selected from the group consisting of carbon black and silica by the total amount of preferably ≥30 parts by mass, more preferably ≥50 parts by mass, with respect to 100 parts by mass of the rubber component. Durability of the tube 110 improves and thus durability of the actuator further improves in this case. The content of the filler is preferably 100 parts by mass, more preferably 70 parts by mass, with respect to 100 parts by mass of the rubber component.

It is preferable that the tube (the rubber layer) 110 contains, in addition to the aforementioned rubber component, at least one material selected from the group consisting of polyvinyl chloride (PVC), poly(zinc acrylate), and aliphatic resin according to applications. Mechanical strength of the tube 110 improves when the tuber (the rubber layer) 110 contains the material described above. Examples of the aliphatic resin include polyolefin-based resin.

The tube (the rubber layer) 110 may contain, in addition to the aforementioned rubber component, yet another/other compounding agent/agents. Examples of the compounding agent include zinc white, stearic acid, antioxidant, plasticizer, sulfur, scorch-preventing agent, vulcanization accelerator, organic peroxide, and the like.

Examples of the antioxidant include N-phenyl-N'-(1,3-diphenylbutyl)-p-phenylenediamine, N-phenyl-N'-(1,3-dimethylbutyl)-p-phenylenediamine, and the like. Examples of the plasticizer include oil and the like, Examples of the scorch-preventing agent include N-(cyclohexylthio)phthalimide, and the like. Examples of the vulcanization accelerator include N-cyclohexyl-2-benzothiazolylsulfenamide (CBS), 1,3-diphenylguanidine (DPG), tetrakis(2-ethylhexyl)thiuram disulfide (TOT), di-2-benzothiazolyl disulfide (MBTS), and the like.

The tube 110 can be manufactured, for example, by: blending the aforementioned rubber component with the compounding agent, thereby preparing a rubber composition; and subjecting the rubber composition to extrusion by an extrusion molding machine.

Figure 6A:
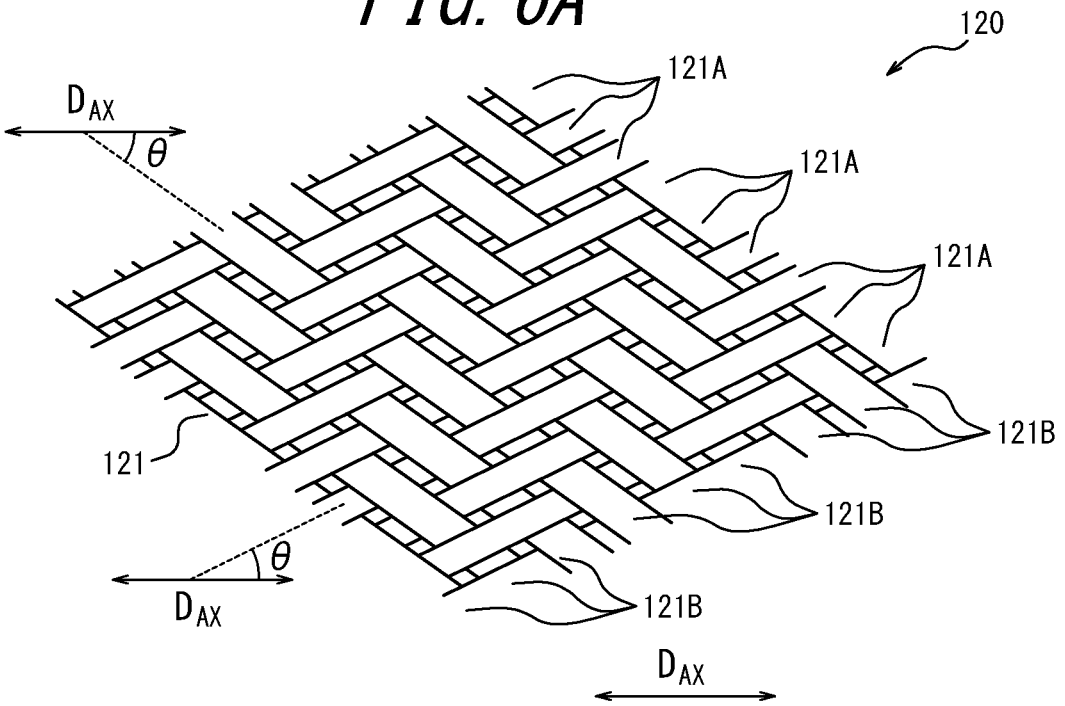
FIGS. 6A and 6B are partial side views of two embodiments of a sleeve 120 in a state of no load and no pressure applied thereon.
Figure 6B:
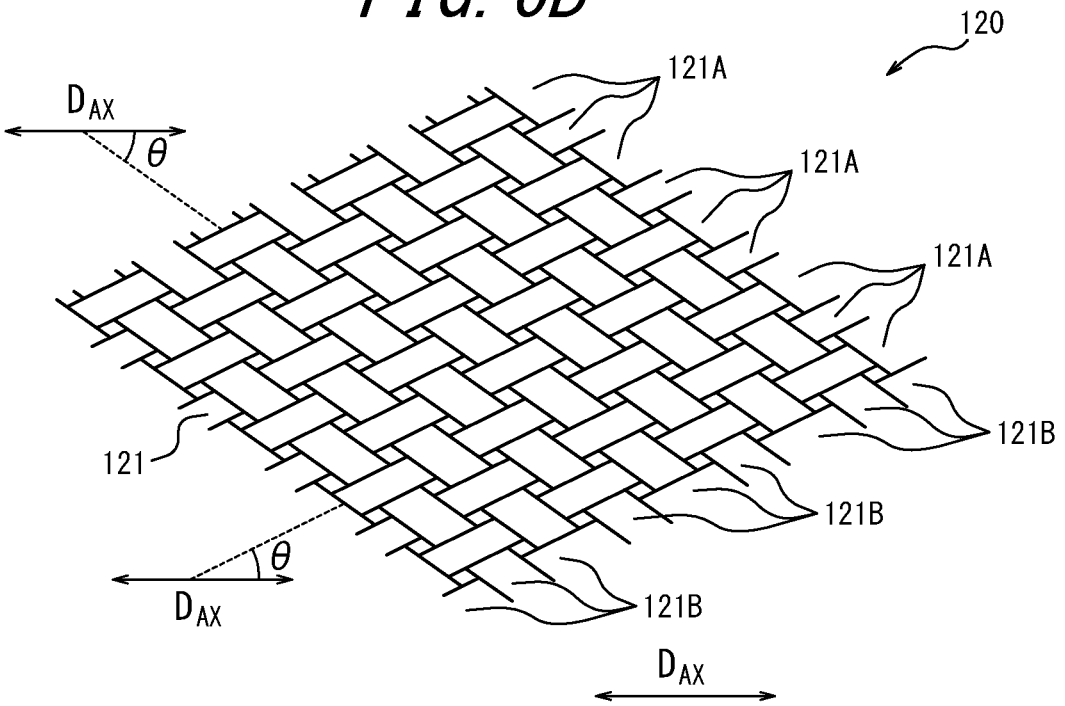

FIGS. 6A and 6B are partial side views of two embodiments of the sleeve 120 in a state of no load and no pressure applied thereon.

In the present disclosure, the average angle θ formed by the cords 121 constituting the sleeve 120 with respect to the axis direction $D_{AX}$ of the actuator with no load and no pressure applied thereon, i.e. at the initial state thereof, is preferably in a range of 25° to 40° (that is, the initial weave reclining angle is preferably in a range of 25° to)40°, as shown in FIG. 6A and FIG. 6B. Setting the average angle θ formed by the cords 121 of the sleeve 120 with respect to the axis direction $D_{AX}$ of the actuator in a state of no load and no pressure applied thereon, to be 25° or larger, enhances durability of the sleeve 120. Setting the average angle θ formed by the cords 121 of the sleeve 120 with respect to the axis direction $D_{AX}$ of the actuator in a state of no load and no pressure applied thereon, to be 40° or less, increases a contraction rate of the actuator. The average angle θ formed by the cords 121 of the sleeve 120 with respect to the axis direction $D_{AX}$ of the actuator in the initial state can be adjusted by, for example, adjusting the direction of the cords 121 when the sleeve 120 is woven and when the sleeve 120 thus woven is formed into a cylindrical shape.

In the present disclosure, the average angle θ formed by the cords 121 of the sleeve 120 with respect to the axis direction $D_{AX}$ of the actuator represents the average acute angle of the two (acute and obtuse) angles respectively formed by the cords 121 of the sleeve 120 with respect to the axis direction $D_{AX}$ of the actuator The fineness per one raw yarn of the cord 121 constituting the sleeve 120 is preferably in the range of 800 to 5000 dtex, more preferably in the range of 800 to 4000 dtex, even more preferably in the range of 1000 to 4000 dtex, yet even more preferably in the range of 1500 to 4000 dtex, and particularly preferably in the range of 2000 to 4000 dtex. In this case, the tube 110 of the actuator bears even smaller load and thus the actuator exhibits further improved durability.

The second twist number and the first twist number of the cords 121 constituting the sleeve 120 are preferably in the range of 4 to 150 (number/10 cm), more preferably in the range of 10 to 36 (number/10 cm), and even more preferably in the range of 10 to 30 (number/10 cm), respectively. The tube 110 of the actuator bears even smaller load and thus the actuator exhibits further improved durability in this case. The second twist number and the first twist number of the cords 121 may be either equal to/different from each other.

The number of the twisted yarns constituting the cord 121 of the sleeve 120 is preferably in the range of 2 to 4 and particularly preferably 2. In this case, the tube 110 of the actuator bears even smaller load and thus the actuator exhibits further improved durability.

Each of the cords 121 constituting the sleeve 120 has a diameter preferably in the range of 0.3 mm to 1.5 mm, more preferably in the range of 0.4 mm to 1.5 mm. In this case, the tube 110 bears even smaller load and thus the actuator exhibits further improved durability.

The number of woven cords 121 constituting the sleeve 120 is preferably in the range of 48 to 96. The number of woven cords 121 constituting the sleeve 120, of 48, ensures a relatively small expansion rate in the radial direction of the sleeve 120 and the tube 110, thereby improving durability of the sleeve 120 and the tube 110. The number of woven cords 121 constituting the sleeve 120, of 96, ensures a satisfactorily large contraction rate.

The sleeve 120 has a cylindrical, woven structure formed by weaving the cords 121 to be disposed in certain directions, wherein the total number of the cords 121 thus woven to form the cylindrical structure corresponds to "the number of woven cords 121". For example, in a case where the sleeve 120 is a mesh cylindrical structure in which the cords 121$A_1$, 121$A_2$, 121$A_X$ disposed at equal intervals in parallel to each other in a spiral manner intersect the cords 121$B_1$, 121$B_2$, 121$B_Y$ disposed at equal intervals in parallel to each other in a spiral manner such that the cords 121$A_{1,2}$, . . . X and the cords 121$B_{1,2,\ldots Y}$ are alternately interwoven, the number of woven cords 121 constituting the sleeve 120 is (X+Y).

The number of bundle (the number of twisted yarn(s) delivered per cord) of the cords 121 constituting the sleeve 120 is preferably in the range of 1 to 2/cord. The tube 110 bears even smaller load and thus the actuator exhibits further improved durability in this case.

When a sleeve 120 is woven by using the braiding technique, one twisted yarn is delivered from each of "a multiple of 4" sites (the "a multiple of 4" corresponds to the number of woven cords) in general. In the present disclosure, the number of woven cords is preferably in the range of 48 to 96. The term "bundle" indicates that a plurality of twisted yarns is delivered from each of the multiple of 4 sites, to be woven. Accordingly, in a case where the number of bundle is 2 and the number of woven cords is 96, for example, the sleeve 120 can be formed by interweaving substantially 192 (2×96=192) twisted yarns, whereby it is possible to significantly decrease the mesh aperture rate in a mesh-opening state and effectively improve durability of the sleeve.

In the present disclosure, cord-driving density of the cords 121 constituting the sleeve 120 is preferably in the range of 6.8 cords/cm to 25.5 cords/cm, more preferably in the range of 10.0 cords/cm to 23.5 cords/cm, and even more preferably in the range of 10.0 cords/cm to 20.0 cords/cm. In this case, the tube 110 of the actuator bears even smaller load and thus the actuator exhibits further improved durability.

It is preferable to use, as the cord 121 constituting 120, a fiber cord made of at least one fiber material selected from the group consisting of: polyamide fiber such as aramid fiber (aromatic polyamide fibers), polyhexamethylene adipamide (Nylon 6.6) fiber, polycaprolactam (Nylon 6) fiber, and the like; polyester fiber such as polyethylene terephthalate (PET) fiber, polyethylene naphthalate (PEN) fiber, and the like; polyurethane fiber; rayon; acrylic fiber; and polyolefin fiber. Durability of the sleeve further improves in this case. It is particularly preferable to use a cord made of aramid fiber among the aforementioned examples in terms of ensuring satisfactory strength of the sleeve 120. Examples of the polyolefin fiber which is preferably used include "SK60" manufactured by TOYOBO CO., LTD.

However, the cord 121 is not restricted to such fiber cords as described above. It is acceptable, for example, to use as the cord 121 a cord made of high strength fiber such as PBO (poly para-phenylene benzobisoxazole) fiber or a metal cord made of ultra-fine filaments.

Surfaces of the fiber/metal cords described above may be covered with rubber, mixture of a thermocurable resin and latex, or the like. In a case where surfaces of the cords are covered with these materials, it is possible to decrease a friction coefficient of the surfaces of the cords to an adequate level, while improving durability of the cords.

A solid content in the mixture of a thermocurable resin and latex is preferably in the range of ≥15 mass % and ≤50 mass % and more preferably in the range of ≥20 mass and ≤40 mass %. Examples of the thermocurable resin include phenol resin, resorcin resin, urethane resin, and the like. Examples of the latex include vinyl pyridine (VP) latex, styrene-butadiene rubber (SBR) latex, acrylonitrile-butadiene rubber (NBR) latex, and the like.

It is preferable that the sleeve 120 is, as shown in FIGS. 5A and 6A, made of one group of cords 121A disposed in one direction and the other group of cords 121B disposed to intersect the cords 121A of the one group, so that pairs of the two intersecting points at which pairs of the cords 121$A_1$; 121$A_2$, 121$A_3$;121$A_4$, . . . intersect one cord 121$B_1$ at the upper/lower side thereof in an alternate manner are shifted by a single cord 121A, in terms of the intersecting points, from pairs of the two intersecting points at which pairs of the cords 121$A_2$;121$A_3$, 121$A_4$; 121$A_5$, . . . intersect another cord 121$B_2$ (adjacent to the one cord 121$B_1$) at the upper/lower side thereof in an alternate manner. That is, it is preferable that the sleeve 120 is woven by a twill weave. In this case, the tube 110 of the actuator bears even smaller load and thus the actuator exhibits further improved durability.

Further, it is also preferable that the sleeve 120 is, as shown in FIGS. 5B and 6B, made of one group of cords 121A disposed in one direction and the other group of cords 121B disposed to intersect the cords 121A of the one group, so that the intersecting points at which the cords 121$A_1$, 121$A_2$, 121$A_n$ intersect one cord 121$B_1$ at the upper/lower side thereof in an alternate manner are shifted, by a single cord 121A, from the intersecting points at which the cords 121$A_2$, 121$A_3$, . . . , 121$A_{n+1}$ intersect another cord 121$B_2$ (adjacent to the one cord 121$B_1$) at the upper/lower side thereof in an alternate manner. That is, it is also preferable that the sleeve 120 is woven by a plain weave. The tube 110 of the actuator bears even smaller load and thus the actuator exhibits further improved durability in this case, as well.

A method for manufacturing the cord 121 is not particularly restricted. For example, in a case where the cord 121 has what is called a double twist structure in which a plurality of yarns (preferably 2 to 4 yarns) are twisted, the cord can be manufactured, for example, by subjecting each yarn to first twist, aligning a plurality of the yarns thus twisted, and subjecting the yarns thus aligned to second twist in the direction opposite to the first twist, thereby obtaining a twisted yarn cord.

Alternatively, in a case where the cord 121 has what is called a single twist structure in which the cord is obtained by single twist of yarn(s), the cord can be manufactured, for example, by aligning yarn(s) and then twisting them in one direction, thereby obtaining a twisted yarn cord.

EXAMPLES

The present disclosure will be described further in detail by Examples hereinafter. The present disclosure is not limited by any means to these Examples.

(Preparation of rubber compositions 1 to 5 and preparation of tubes therefrom)

Rubber composition samples were prepared by mixing and kneading the relevant respective components according to the blend formulation shown in FIG. 1. Each of the rubber composition samples thus obtained was subjected to molding and vulcanization under the conditions shown in Table 1, whereby a cylindrical tube sample having a length of 300 mm was prepared. Storage elastic modulus E' at 25° C. was measured for the tube sample thus prepared, according to the method described below.

<Method for measuring storage elastic modulus E' at 25° C.>

Each of the tube samples was cut open in the axis direction thereof by a cutter. The sample thus cut open was subjected to punching, so that a sample strip (6 mm×36 mm) was punched out in a direction in parallel to the radial direction of the original tube. A storage elastic modulus E' value in a linear region of the sample strip was measured by using "DMS7100" (manufactured by Hitachi High-Tech Corporation) under the conditions of: temperature in the range of −150° C. to 150° C.; temperature increasing rate of 3° C./minute; frequency of 1 Hz; strain quantity of 0.05%; and "Tensile mode" as the experiment mode).

(Preparation of rubber composition 6 and preparation of tube therefrom)

A rubber composition sample was prepared by mixing and kneading the relevant respective components according to the blend formulation shown in FIG. 1.

The rubber composition sample thus obtained was subjected to molding and vulcanization under the conditions shown in Table 1, whereby a cylindrical tube sample having a length of 300 mm was prepared. Storage elastic modulus E' at 25° C. was measured for the tube sample thus prepared, according to the method described above.

TABLE 1

| | | | Composition 1 | Composition 2 | Composition 3 | Composition 4 | Composition 5 | Composition 6 |
|---|---|---|---|---|---|---|---|---|
| Blend formulation | NR *1 | Parts by mass | 50 | 30 | 50 | 50 | — | — |
| | Modified BR *2 | | 30 | — | 30 | 30 | — | — |
| | BR1 *3 | | — | 70 | — | — | — | — |
| | BR2 *4 | | — | — | — | — | 20 | — |
| | IR *5 | | 20 | — | 20 | 20 | — | — |
| | NBR *6 | | — | — | — | — | 80 | — |
| | LLDPE *7 | | — | — | — | — | — | 100 |
| | CB1 *8 | | — | 40 | — | — | — | — |
| | CB2 *9 | | — | — | — | — | 50 | — |
| | CB3 *10 | | 30 | — | 30 | 50 | — | — |
| | C5 resin *11 | | — | — | — | — | 10 | — |
| | Process oil | | 5 | 10 | 5 | 5 | — | — |
| | Tackifier *12 | | 1 | — | 1 | 1 | — | — |
| | Other chemical agents *13 | | 9.0 | 6.5 | 9.0 | 9.0 | 13.5 | — |
| | Vulcanizing agents package *14 | | 2.55 | 2 | 2.55 | 2.55 | 4.53 | — |
| | Antioxidant *15 | | 1 | 3.5 | 1 | 1 | — | — |

TABLE 1-continued

| | | | Composition 1 | Composition 2 | Composition 3 | Composition 4 | Composition 5 | Composition 6 |
|---|---|---|---|---|---|---|---|---|
| Molding condition | Molding temperature | ° C. | 150 | 150 | 160 | 150 | 150 | 150 |
| | Molding (vulcanization) time | Minute | 50 | 50 | 60 | 50 | 50 | 30 |
| Physical property | Storage elastic modulus E' at 25° C. | MPa | 13.2 | 2.7 | 7.6 | 22.4 | 3 | 150 |

*1 NR: natural rubber
*2 Modified BR: modified butadiene rubber manufactured by JSR Corporation
*3 BR1: butadiene rubber, product name "BR01" manufactured by JSR Corporation
*4 BR2: butadiene rubber, product name "UBEPOL VCR412" manufactured by Ube Industries, Ltd.
*5 IR: isoprene rubber, product name "IR2200" manufactured by JSR Corporation
*6 NBR: acrylonitrile-butadiene rubber, the total content of acrylonitrile-butadiene rubber including at least product name "N220S" manufactured by JSR
*7 LLDPE: linear low-density polyethylene, product name "UR951" manufactured by Japan Polyethylene Corporation
*8 CB1: carbon black, N550
*9 CB2: carbon black, corresponding to HAF
*10 CB3: carbon black, product name "#120" manufactured by Asahi Carbon Co., Ltd.
*11 C5 resin: product name "QuintoneA 100", manufactured by Zeon Corporation
*12 Tackifier: a product manufactured by JXTG Nippon Oil & Energy Corporation
*13 Other chemical agents: the total content of chemical agents such as: plasticizer other than process oil and resins; zinc oxide; wax; and the like
*14 Vulcanizing agents package: the total content of sulfur, vulcanization accelerator and retarder
*15 Antioxidant: "Noclac 6C" manufactured by Ouchi Shiko Chemical Industrial Co., Ltd.

(Preparation of Sleeve)

Each of mesh cylindrical sleeve samples was prepared by weaving aramid fiber cord having the characteristics thereof shown in Table 2.

The aramid fiber cord used for preparation of sleeve sample 1 had: cord diameter in the range of 0.4 mm to 0.5 mm; the fineness per one raw yarn of the cord, of 1100 dtex; density of raw yarn, of 1.39 g/cm$^3$; the number of the raw yarns twisted to constitute the cord, of 2/cord; the first twist number of 12 (number/10 cm); the second twist number of 12 (number/10 cm); the weave reclining angle of 25°; the number of woven cords, of 64; and the number of bundle (the number of twisted yarn(s) delivered per cord), of 1/cord. In respect of sleeve samples 2 to 11, the fineness per one raw yarn, the first twist number, the second twist number, the number of the raw yarns/cord, the weave reclining angle, the number of woven cords, the number of bundle, and the like were changed, respectively, from those of sleeve sample 1. The aramid fiber cord used for preparation of sleeve samples 1 to 7 had the number of the raw yarns, of 2/cord. The aramid fiber cord used for preparation of sleeve samples 8 to 11 had the number of the raw yarn, of 1/cord.

Each of the aramid fiber cords was prepared by subjecting the aramid fibers as raw yarns to first twist and then second twist. Accordingly, each sleeve sample had a mesh cylindrical structure wherein the aramid fiber cords, of which number corresponds to the number of woven cords shown in Table 2, were observed along a circumference of a cross section thereof.

Specifically, each sleeve sample had a mesh cylindrical structure in which one group of the aramid fiber cords disposed in parallel to each other at equal intervals therebetween to collectively form a spiral configuration (the number of cords of the one group was a half of "the number of woven cords") intersect and the other group of the aramid fiber cords disposed in parallel to each other at equal intervals therebetween to collectively form another spiral configuration (the number of cords of the other group was a half of "the number of woven cords") such that the one group of the aramid fiber cords and the other group of the aramid fiber cords were alternately interwoven. More specifically, the sleeve sample was formed so that pairs of the two intersecting points at which pairs of the cords 121A$_1$; 121A$_2$, 121A$_3$;121A$_4$, . . . intersect one cord 121B$_1$ at the upper/lower side thereof in an alternate manner were shifted by a single cord 121A, in terms of the intersecting points, from pairs of the two intersecting points at which pairs of the cords 121A$_2$;121A$_3$, 121A$_4$;121A$_5$, . . . intersect another cord 121B$_2$ (adjacent to the one cord 121B$_1$) at the upper/lower side thereof in an alternate manner, as shown in FIG. 6A. That is, the sleeve sample was woven by a twill weave.

The relevant characteristics of each sleeve sample, as well as those of the cords constituting the sleeve sample, are shown in Table 2.

TABLE 2

| | | | Sleeve sample 1 | Sleeve sample 2 | Sleeve sample 3 | Sleeve sample 4 | Sleeve sample 5 | Sleeve sample 6 |
|---|---|---|---|---|---|---|---|---|
| Characteristics changed from sleeve sample 1 | | | — | Weave reclining angle: small | Weave reclining angle: small | Weave reclining angle: large | Weave reclining angle: large | Twist number: increased |
| Filament as raw yarn | Material | — | aramid | aramid | aramid | aramid | aramid | aramid |
| | Fineness per one raw yarn | dtex | 1100 | 1100 | 1100 | 1100 | 1100 | 1100 |
| Twisted yarn | Second twist number | twist/10 cm | 12 | 12 | 12 | 12 | 12 | 22 |
| | First twist number | twist/10 cm | 12 | 12 | 12 | 12 | 12 | 22 |
| | Fineness per one twisted yarn | dtex | 2200/2 | 2200/2 | 2200/2 | 2200/2 | 2200/2 | 2200/2 |

TABLE 2-continued

| | | | | | | | | |
|---|---|---|---|---|---|---|---|---|
| Sleeve | Weave reclining angle | ° | 25 | 15 | 20 | 30 | 35 | 25 |
| | The number of woven cords | — | 64 | 64 | 64 | 64 | 64 | 64 |
| | The number of bundle | — | 1 | 1 | 1 | 1 | 1 | 1 |

| | | | Sleeve sample 7 | Sleeve sample 8 | Sleeve sample 9 | Sleeve sample 10 | Sleeve sample 11 |
|---|---|---|---|---|---|---|---|
| Characteristics changed from sleeve sample 1 | | | Fineness/yarn and Twist number: increased | Number of raw yarns/cord: decreased Twist number: increased | Number of raw yarns/cord: decreased Twist number: increased Number of woven cords: increased | Number of raw yarns/cord: decreased Twist number: increased Number of woven cords: increased | Fineness of yarn: decreased Number of raw yarns/cord: decreased Twist number: increased Number of bundle: increased |
| Filament as raw yarn | Material | — | aramid | aramid | aramid | aramid | aramid |
| | Fineness per one raw yarn | dtex | 1670 | 1100 | 1100 | 1100 | 800 |
| Twisted yarn | Second twist number | twist/10 cm | 17 | 17 | 17 | 31 | 20 |
| | First twist number | twist/10 cm | 17 | 17 | 17 | 31 | 20 |
| | Fineness per one twisted yarn | dtex | 3340/2 | 1100/1 | 1100/1 | 1100/1 | 800/1 |
| Sleeve | Weave reclining angle | ° | 25 | 25 | 25 | 25 | 25 |
| | The number of woven cords | — | 64 | 64 | 96 | 96 | 64 |
| | The number of bundle | — | 1 | 1 | 1 | 1 | 2 |

Examples 1 to 5 and Comparative Examples 1 to 3, 6, 7 and 10

(Preparation of Actuator)

Each of actuators samples, having the structures shown in FIGS. 1 and 2, was prepared by using the tube sample and the mesh sleeve sample corresponding thereto. The distance between the sealing mechanism 200 and the sealing mechanism 300 of the actuator sample was 250 mm. "COSMO SUPER EPOCH UF46" manufactured by COSMO OIL LUBRICANTS Co., Ltd. was used as hydraulic oil for the tube integrated in the actuator. Durability of the actuator sample thus prepared was evaluated by the method described below. The results are shown in Table 3 and Table 4.

The blending formulation of the composition(s) used in the tube and the inner diameter $r_0$ and thickness of the tube, of each of the actuator samples, are shown in Table 3 and Table 4. The tube of the Comparative Example 10 had a two-layer structure wherein the innermost layer used composition 5, the outermost layer used composition 1, and the thickness values of the innermost layer and the outermost layer are shown in Table 4, respectively. Each of the tubes of Examples and other Comparative Examples had a single-layer structure wherein the type of the composition used for the tube and the thickness of the tube are shown in the "Formulation of the outermost layer" and "Thickness of the outermost layer", respectively, for convenience.

Further, the sample number of the sleeve sample used for each of the actuator samples is shown in Table 3 and Table 4.

<Method for Measuring Angle Formed by Cord Constituting Sleeve>

The angle formed by the cord constituting the sleeve with respect to the axis direction of the actuator was determined as described below, i.e. by:

(1) photographing a relevant portion of the actuator;

(2) selecting an image of the middle portion of the actuator (the portion where the image is well focused and the satisfactory image quality for analysis is ensured, the portion corresponding to a region where a decrease in diameter of the sleeve is within 5% with respect to the largest diameter of the sleeve);

(3) measuring, in the image of the middle portion thus selected, angles formed by the cords constituting the sleeve with respect to the axis direction centerline of the sealing mechanism; and (4) calculating the average of five values of angles thus measured, and regarding the average as a measurement value.

The angle formed by the cord with respect to the axis direction was measured in a state of no load and no pressure applied to the actuator and is indicated as "weave reclining angle" in Table 2.

<Method for Measuring Mesh Aperture Rate A of Cord Constituting Sleeve in Pressurized State>

A mesh aperture rate of the cord constituting the sleeve was measured by: determining the total area (S2) of clearances between the cords through photographic analysis made in a manner similar to the "Method for measuring angle formed by cord constituting sleeve" described above" at the liquid pressure of 5 MPa; determining the area (S1) of an outer peripheral surface of the actuator main body; and calculating a ratio (S2/S1) by using S1 and S2 thus determined, which ratio represents a mesh aperture rate. The mesh aperture rate thus obtained is shown as "Cord mesh aperture rate A in pressurized state" (expressed by %) in Table 3 and Table 4.

<Method for Evaluating Durability of Actuator>

Durability of each of the actuator samples was determined by: injecting the hydraulic oil into the tube and completely substituting air in the tube with the hydraulic oil;

controllably injecting the hydraulic oil such that the pressure of the hydraulic oil in the tube reciprocally changed between 0 MPa and 5 MPa in an alternate and repetitive manner at every 3 seconds, in a state where a tensile load was exerted on one side of the actuator sample by a pneumatic cylinder such that the expandable and contractable portion of the actuator sample had already shrunk, prior to being pressurized, by 20% as compared with the standard or default length thereof with no pressure applied thereon; counting the number of injections until cracks generated in the tube grew such that the actuator could no longer function or until the sleeve broke so that the actuator could no longer function; evaluating that durability was "satisfactory" when the number of injections or changes in pressure thus counted was 8000 times and "unsatisfactory" when the number of injections or changes in pressure thus counted was less than 8000 times. Types of the "out of order" mode of the actuator samples are also shown in Table 3 and Table 4.

Examples 6 to 9 and Comparative Examples 4, 5, 8, 9, 11 and 12

Actuator samples are prepared in a manner similar to Examples 1 to 3 according to the descriptions in Table 3 and Table 4, so that a cord mesh aperture rate A in a pressurized state is calculated and durability is evaluated for each of the actuator samples.

TABLE 3

| | | | Example 1 | Example 2 | Example 3 | Example 4 | Example 5 |
|---|---|---|---|---|---|---|---|
| Tube | Formulation of the outermost layer | — | Composition 1 | Composition 1 | Composition 1 | Composition 1 | Composition 1 |
| | Formulation of the innermost layer | — | — | — | — | — | — |
| | Inner diameter $r_0$ | mm | 9.6 | 9.6 | 9.6 | 9.6 | 9.6 |
| | Thickness of the outermost layer | mm | 3.4 | 3.4 | 3.4 | 3.4 | 3.4 |
| | Thickness of the innermost layer | mm | — | — | — | — | — |
| | Storage elastic modulus E' of the tube at 25° C. | MPa | 13.2 | 13.2 | 13.2 | 13.2 | 13.2 |
| Sleeve | Sleeve sample number | — | Sleeve 1 | Sleeve 4 | Sleeve 5 | Sleeve 9 | Sleeve 10 |
| Test conditions | Inner pressure | MPa | 5 | 5 | 5 | 5 | 5 |
| | Shrinking late with tensile load exerted thereon | % | 20 | 20 | 20 | 20 | 20 |
| Durability | Cord mesh aperture rate A in pressurized state | — | 0.090 | 0.078 | 0.060 | 0.088 | 0.093 |
| | | % | 9.0 | 7.8 | 6.0 | 8.8 | 9.3 |
| | Durability factor value of actuator | — | 51.9 | 59.9 | 77.9 | 53.1 | 50.3 |
| | Count of the maximum repetitive injections | Times | 8000 | 50000 | 100000 | 40000 | 11000 |
| | "Out of order" mode | — | Tube cracked | Tube cracked | Sleeve broke | Sleeve broke | Sleeve broke |
| | Evaluation | — | Satisfactory | Satisfactory | Satisfactory | Satisfactory | Satisfactory |

| | | | Example 6 | Example 7 | Example 8 | Example 9 |
|---|---|---|---|---|---|---|
| Tube | Formulation of the outermost layer | — | Composition 1 | Composition 4 | Composition 1 | Composition 1 |
| | Formulation of the innermost layer | — | — | — | — | — |
| | Inner diameter $r_0$ | mm | 9.6 | 9.6 | 12.0 | 5.0 |
| | Thickness of the outermost layer | mm | 3.4 | 3.4 | 2.2 | 5.7 |
| | Thickness of the innermost layer | mm | — | — | — | — |
| | Storage elastic modulus E' of the tube at 25° C. | MPa | 13.2 | 22.4 | 13.2 | 13.2 |
| Sleeve | Sleeve sample number | — | Sleeve 11 | Sleeve 1 | Sleeve 1 | Sleeve 1 |
| Test conditions | Inner pressure | MPa | 5 | 5 | 5 | 5 |
| | Shrinking late with tensile load exerted thereon | % | 20 | 20 | 20 | 20 |
| Durability | Cord mesh aperture rate A in pressurized state | — | 0.050 | 0.096 | 0.048 | 0.070 |
| | | % | 5.0 | 9.6 | 4.8 | 7.0 |
| | Durability factor value of actuator | — | 93.5 | 82.6 | 50.4 | 214.9 |
| | Count of the maximum repetitive injections | Times | 100000 | 20000 | 20000 | 20000 |
| | "Out of order" mode | — | Sleeve broke | Tube cracked | Tube cracked | Tube cracked |
| | Evaluation | — | Satisfactory | Satisfactory | Satisfactory | Satisfactory |

TABLE 4

| | | | Comp. Ex. 1 | Comp. Ex. 2 | Comp. Ex. 3 | Comp. Ex. 4 | Comp. Ex. 5 | Comp. Ex. 6 |
|---|---|---|---|---|---|---|---|---|
| Tube | Formulation of the outermost layer | — | Composition 1 | Composition 1 | Composition 1 | Composition 1 | Composition 1 | Composition 2 |
| | Formulation of the innermmost layer | — | — | — | — | — | — | — |
| | Inner diameter $r_0$ | mm | 9.6 | 9.6 | 9.6 | 9.6 | 9.6 | 9.6 |
| | Thickness of the outermost layer | mm | 3.4 | 3.4 | 3.4 | 3.4 | 3.4 | 3.4 |
| | Thickness of the innermost layer | mm | — | — | — | — | — | — |

TABLE 4-continued

| | | | | | | | | |
|---|---|---|---|---|---|---|---|---|
| | Storage elastic modulus E' of the tube at 25° C. | MPa | 13.2 | 13.2 | 13.2 | 13.2 | 13.2 | 2.7 |
| Sleeve | Sleeve sample number | — | Sleeve 2 | Sleeve 3 | Sleeve 6 | Sleeve 7 | Sleeve 8 | Sleeve 1 |
| Test conditions | Inner pressure | MPa | 5 | 5 | 5 | 5 | 5 | 5 |
| | Shrinking rate with tensile bad exerted thereon | % | 20 | 20 | 20 | 20 | 20 | 20 |
| Durability | Cord mesh aperture rate A in pressurized state | — | 0.450 | 0.392 | 0.262 | 0.101 | 0.250 | 0.200 |
| | | % | 45.0 | 39.2 | 26.2 | 10.1 | 25.0 | 20.0 |
| | Durability factor value of actuator | — | 10.4 | 11.9 | 17.8 | 46.3 | 18.7 | 4.8 |
| | Count of the maximum repetitive injections | Times | 10 | 100 | 5000 | 3000 | 3000 | 50 |
| | "Out of order" mode | — | Tube cracked | Tube cracked | Tube cracked | Tube cracked | Sleeve broke | Tube cracked |
| | Evaluation | — | Unsatisfactory | Unsatisfactory | Unsatisfactory | Unsatisfactory | Unsatisfactory | Unsatisfactory |

| | | | Comp. Ex. 7 | Comp. Ex. 8 | Comp. Ex. 9 | Comp. Ex. 10 | Comp. Ex. 11 | Comp. Ex. 12 |
|---|---|---|---|---|---|---|---|---|
| Tube | Formulation of the outermost layer | — | Composition 3 | Composition 5 | Composition 6 | Composition 1 | Composition 1 | Composition 1 |
| | Formulation of the innermmost layer | — | — | — | — | Composition 5 | — | — |
| | Inner diameter $r_0$ | mm | 9.6 | 5.0 | 9.6 | 9.6 | 14.3 | 1.0 |
| | Thickness of the outermost layer | mm | 3.4 | 5.7 | 3.4 | 1.7 | 1.0 | 7.7 |
| | Thickness of the innermost layer | mm | — | — | — | 1.7 | — | — |
| | Storage elastic modulus E' of the tube at 25° C. | MPa | 7.6 | 3 | 150 | 8 | 13.2 | 13.2 |
| Sleeve | Sleeve sample number | — | Sleeve 1 | Sleeve 1 | Sleeve 1 | Sleeve 1 | Sleeve 1 | Sleeve 1 |
| Test conditions | Inner pressure | MPa | 5 | 5 | 5 | 5 | 5 | 5 |
| | Shrinking rate with tensile bad exerted thereon | % | 20 | 20 | ≤1 | 20 | 20 | ≤1 |
| Durability | Cord mesh aperture rate A in pressurized state | — | 0.100 | 0.090 | 0.010 | 0.137 | 0.200 | 0.010 |
| | | % | 10.0 | 9.0 | 1.0 | 13.7 | 20.0 | 1.0 |
| | Durability factor value of actuator | — | 26.9 | 38.0 | 5312.5 | 20.7 | 4.6 | 10164 |
| | Count of the maximum repetitive injections | Times | 7000 | 50 | Testing impossible | 3000 | 10 | Testing impossible |
| | "Out of order" mode | — | Sleeve broke | Tube cracked | — | Tube cracked | Tube cracked | — |
| | Evaluation | — | Unsatisfactory | Unsatisfactory | Unsatisfactory | Unsatisfactory | Unsatisfactory | Unsatisfactory |

It is understood from the results shown in Table 3 and Table 4 that the actuator samples of Examples according to the present disclosure unanimously high durability.

REFERENCE SIGNS LIST

10: Actuator
20: Connection portions
100: Actuator main body
110: Tube
120: Sleeve
120*a*: Folded-back portion
120*b*: Sleeve main body
121: Cord
121A, 121B: Cords
122: Clearance between cords
200: Sealing mechanism
210: Sealing member
211: Trunk portion
212: Flange portion
213: Irregular portion
214: Small diameter portion
215: Passage hole
220: Locking ring
230: Caulking member
231: Indentation
240: Adhesive layer
300: Sealing mechanism
400, 500: Fitting
410, 510: Passage hole
$D_{AX}$: Axis direction
$D_R$: Radial direction

The invention claimed is:

1. An actuator having an actuator main body constituted of a cylindrical tube capable of expanding/contracting by hydraulic pressure and a sleeve for covering an outer peripheral surface of the tube, the sleeve having a cylindrical structure formed by cords woven to be disposed in predetermined directions, wherein:

the inner diameter $r_0$ in mm of the tube, the thickness t mm of the tube, the storage elastic modulus E' in MPa of the tube at 25° C., and the mesh aperture ratio A of the cords constituting the sleeve in a pressurized state satisfy the following formula (1):

$$60 \leq E' \times (t/r_0)/A \leq 200 \quad (1)$$

wherein said mesh aperture ratio (A) is a ratio (S2/S1) of the total area (S2) of clearances between the cords constituting the sleeve with respect to an area (S1) of an outer peripheral surface of the actuator main body, $0.005 \leq A \leq 0.06$, and $10 \leq E' \leq 40$.

2. The actuator of claim 1, wherein the tube includes one or more rubber layers and at least one of the rubber layers contains at least one selected from the group consisting of natural rubber, isoprene rubber, styrene-butadiene rubber, butadiene rubber, chloroprene rubber, ethylene-propylene-diene rubber, acrylonitrile-butadiene rubber, hydrogenated acrylonitrile-butadiene rubber, butyl rubber, polyisobutylene rubber, silicone rubber, urethane elastomer, polyvinyl alcohol resin, acrylate resin, ethylene polyvinyl alcohol resin, cellulose-based resin, polyamide-based resin, polyacrylic acid, modified products thereof, and at least partially hydrogenated products thereof.

3. The actuator of claim 1, wherein the tube includes one or more rubber layers and at least one of the rubber layers contains at least one filler selected from the group consisting of carbon black and silica.

4. The actuator of claim 3, wherein at least one of the rubber layers contains at least one filler selected from the group consisting of carbon black and silica by the total amount of 30 parts by mass with respect to 100 parts by mass of the rubber component.

5. The actuator of claim 1, wherein the cords which constitute the sleeve is made of at least one fiber material selected from the group consisting of polyamide fiber, polyester fiber, polyurethane fiber, rayon, acrylic fiber, and polyolefin fiber.

6. The actuator of claim 5, wherein the cords constituting the sleeve is made of aramid fiber.

7. The actuator of claim 1, wherein the fineness per one raw yarn of the cords constituting the sleeve is in the range of 800 dtex to 5000 dtex.

8. The actuator of claim 1, wherein both a second twist number per 10 cm and a first twist number per 10 cm are in the range of 4 to 150:

wherein said cords have a double twist structure of a plurality of yarns, obtainable by subjecting each yarn to said first twist, aligning a plurality of the yarns thus twisted, and subjecting said aligned plurality of yarns to said second twist in a direction opposite to said first twist, to obtain a twisted yarn cord.

9. The actuator of claim 1, wherein the average angle θ formed by the cords of the sleeve with respect to the axis direction of the actuator with no load and no pressure applied thereon is in a range of 25° to 40°.

10. The actuator of claim 1, wherein the number of woven cords constituting the sleeve is in the range of 48 to 96 and the number of bundle or the number of twisted yarn(s) delivered per cord is in the range of 1 to 2/cord.

11. The actuator of claim 2, wherein the tube includes one or more rubber layers and at least one of the rubber layers contains at least one filler selected from the group consisting of carbon black and silica.

12. The actuator of claim 11, wherein at least one of the rubber layers contains at least one filler selected from the group consisting of carbon black and silica by the total amount of 30 parts by mass with respect to 100 parts by mass of the rubber component.

13. The actuator of claim 2, wherein the cords which constitute the sleeve is made of at least one fiber material selected from the group consisting of polyamide fiber, polyester fiber, polyurethane fiber, rayon, acrylic fiber, and polyolefin fiber.

14. The actuator of claim 13, wherein the cords constituting the sleeve is made of aramid fiber.

15. The actuator of claim 2, wherein the fineness per one raw yarn of the cords constituting the sleeve is in the range of 800 dtex to 5000 dtex.

16. The actuator of claim 2, wherein both athc second twist number per 10 cm and athc first twist number per 10 cm are in the range of 4 to 150;

wherein said cords have a double twist structure of a plurality of yarns, obtainable by subjecting each yarn to said first twist, aligning a plurality of the yarns thus twisted, and subjecting said aligned plurality of yarns to said second twist in a direction opposite to said first twist, to obtain a twisted yarn cord.

17. The actuator of claim 2, wherein the average angle θ formed by the cords of the sleeve with respect to the axis direction of the actuator with no load and no pressure applied thereon is in a range of 25° to 40°.

18. The actuator of claim 2, wherein the number of woven cords constituting the sleeve is in the range of 48 to 96 and the number of bundle or the number of twisted yarn(s) delivered per cord is in the range of 1 to 2/cord.

19. The actuator of claim 3, wherein the cords which constitute the sleeve is made of at least one fiber material selected from the group consisting of polyamide fiber, polyester fiber, polyurethane fiber, rayon, acrylic fiber, and polyolefin fiber.

20. The actuator of claim 19, wherein the cords constituting the sleeve is made of aramid fiber.

* * * * *